US008396398B2

(12) United States Patent
Taguchi et al.

(10) Patent No.: US 8,396,398 B2
(45) **Date of Patent: *Mar. 12, 2013**

(54) METHOD AND TONER BOTTLE FOR IMAGE FORMING APPARATUS CAPABLE OF EFFECTIVELY SUPPLYING TONER TO IMAGE FORMING APPARATUS

(75) Inventors: Nobuyuki Taguchi, Tokyo (JP); Misaki Uchiyama, Tokyo (JP); Masahiro Kurita, Yokohama (JP); Goro Katsuyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/364,807

(22) Filed: Feb. 2, 2012

(65) Prior Publication Data

US 2012/0141171 A1 Jun. 7, 2012

Related U.S. Application Data

(62) Division of application No. 12/816,018, filed on Jun. 15, 2010, now Pat. No. 8,121,525, which is a division of application No. 12/405,309, filed on Mar. 17, 2009, now Pat. No. 7,747,202, which is a division of application No. 11/230,964, filed on Aug. 16, 2005, now Pat. No. 7,720,416.

(30) Foreign Application Priority Data

Aug. 16, 2004 (JP) ..... 2004-236249
Aug. 31, 2004 (JP) ..... 2004-252324

(51) Int. Cl.
*G03G 15/08* (2006.01)

(52) U.S. Cl. ..... 399/263; 399/120

(58) Field of Classification Search ..... 399/120, 399/258, 262, 263
See application file for complete search history.

(56) References Cited

U.S. PATENT DOCUMENTS

| | | | |
|---|---|---|---|
| 4,611,899 | A | 9/1986 | Kasamura et al. |
| 4,878,603 | A | 11/1989 | Ikesue et al. |
| 5,184,181 | A | 2/1993 | Kurando et al. |
| 5,441,177 | A | 8/1995 | Yanagisawa |
| 5,455,662 | A | 10/1995 | Ichikawa et al. |
| 5,515,143 | A | 5/1996 | Shiotani |
| 5,526,101 | A | 6/1996 | Weed |
| 5,548,384 | A | 8/1996 | Weed |
| 5,557,382 | A | 9/1996 | Tatsumi et al. |
| 5,648,840 | A | 7/1997 | Ikunami et al. |
| 5,659,860 | A | 8/1997 | Sasaki et al. |
| 5,722,014 | A | 2/1998 | Fike |
| 5,722,019 | A | 2/1998 | Nakajima |
| 5,754,916 | A | 5/1998 | Kitayama et al. |
| 5,758,235 | A | 5/1998 | Kosuge et al. |

(Continued)

FOREIGN PATENT DOCUMENTS

| | | |
|---|---|---|
| EP | 0 435 596 | 7/1991 |
| EP | 0 616 268 | 9/1994 |

(Continued)

*Primary Examiner* — Joseph S Wong
(74) *Attorney, Agent, or Firm* — Oblon, Spivak, McClelland, Maier & Neustadt, L.L.P.

(57) ABSTRACT

The toner bottle exchangeably used in an image forming apparatus. The toner bottle includes a bottle body having a substantially cylindrical shape and configured to contain toner, a gear configured to rotate a part of the toner bottle, a cap attached to the bottle body and including an opening arranged in a circumferential surface of the cap and configured to output toner to a development apparatus of the image forming apparatus, a toner conveyance mechanism arranged in the bottle body and configured to convey the toner to the opening.

5 Claims, 15 Drawing Sheets

U.S. PATENT DOCUMENTS 5,765,059 A 6/1998 Kosuge et al.
5,765,079 A 6/1998 Yoshiki et al.
5,768,664 A 6/1998 Kosuge et al.
5,774,773 A 6/1998 Otsuka et al.
5,794,108 A 8/1998 Yoshizawa et al.
5,828,935 A 10/1998 Tatsumi et al.
5,867,757 A 2/1999 Okazaki et al.
5,890,040 A 3/1999 Matsuoka et al.
5,909,610 A 6/1999 Yoshiki et al.
5,913,097 A 6/1999 Nakano et al.
5,915,155 A 6/1999 Shoji et al.
5,918,092 A 6/1999 Hama
5,966,574 A 10/1999 Ui et al.
5,970,290 A 10/1999 Yoshiki et al.
5,991,584 A 11/1999 Meyer et al.
6,104,900 A 8/2000 Ishikawa et al.
6,104,902 A 8/2000 Meyer et al.
6,118,951 A 9/2000 Kato et al.
6,125,243 A 9/2000 Shoji et al.
6,141,520 A 10/2000 Kosuge
6,163,666 A 12/2000 Hosokawa et al.
6,169,864 B1 1/2001 Baxendell et al.
6,185,401 B1 2/2001 Kanamori et al.
6,198,895 B1 3/2001 Tsuda et al.
6,212,343 B1 4/2001 Hosokawa et al.
6,246,854 B1 6/2001 Kurosawa et al.
6,256,469 B1 7/2001 Taniyama et al.
6,256,470 B1 7/2001 Taniyama et al.
6,266,501 B1 7/2001 Mizuishi et al.
6,289,195 B1 9/2001 Ichikawa et al.
6,292,644 B1 9/2001 Goto et al.
6,298,208 B1 10/2001 Kawamura et al.
6,336,020 B1 1/2002 Ishikawa et al.
6,337,957 B1 1/2002 Tamaki et al.
6,363,237 B1 3/2002 Nagame et al.
6,366,755 B1 4/2002 Takashima
6,393,241 B1 5/2002 Matsumoto et al.
6,447,973 B1 9/2002 Asami et al.
6,470,163 B1 10/2002 Minagawa
6,493,529 B1 12/2002 Umemura et al.
6,501,913 B2 12/2002 Hattori et al.
6,507,720 B2 1/2003 Kabumoto et al.
6,521,386 B1 2/2003 Sakon et al.
6,522,855 B1 2/2003 Katoh et al.
6,558,862 B2 5/2003 Kojima et al.
6,560,431 B2 5/2003 Hosokawa
6,562,529 B1 5/2003 Kojima et al.
6,567,637 B2 5/2003 Yanagisawa et al.
6,591,077 B2 7/2003 Yanagisawa et al.
6,615,013 B2 9/2003 Arai et al.
6,628,908 B2 9/2003 Matsumoto et al.
6,665,508 B2 12/2003 Sudo et al.
6,701,112 B2 3/2004 Kusano et al.
6,731,897 B2 5/2004 Nagano et al.
6,766,135 B2 7/2004 Wang et al.
6,775,503 B2 8/2004 Hattori et al.
6,785,497 B1 8/2004 Hasebe
6,826,381 B2 11/2004 Muramatsu et al.
D500,076 S 12/2004 Takuwa
6,859,634 B2 2/2005 Itoh et al.
6,895,191 B2 5/2005 Rommelmann et al.
6,898,407 B2 5/2005 Noguchi et al.
6,917,779 B2 7/2005 Fujimori et al.
6,937,838 B2 8/2005 Ishii et al.
6,975,830 B2 12/2005 Murakami et al.
6,987,940 B2 1/2006 Tamura
7,003,255 B2 2/2006 Kawasumi et al.
7,010,249 B2 3/2006 Hattori
7,016,629 B2 3/2006 Ishii et al.
7,024,133 B2 4/2006 Nagashima et al.
7,035,574 B2 4/2006 Deguchi et al.
7,043,173 B2 5/2006 Grune et al.
7,088,942 B2 8/2006 Minagawa
D532,037 S 11/2006 Tsuda et al.
7,136,610 B2 11/2006 Arai et al.
7,181,152 B2 2/2007 Kuma et al.
7,184,691 B2 2/2007 Kita et al.
7,212,767 B2 5/2007 Hosokawa et al.
7,215,907 B2 5/2007 Fukuchi et al.
7,221,891 B2 5/2007 Matsumoto et al.
7,233,747 B2 6/2007 Tomitaka
7,245,852 B2 7/2007 Takuwa
7,248,824 B2 7/2007 Takami
7,263,309 B2 8/2007 Noguchi et al.
7,313,349 B2 12/2007 Suzuki et al.
7,321,744 B2 1/2008 Hosokawa et al.
7,346,299 B2 3/2008 Muramatsu et al.
7,398,038 B2 7/2008 Tsuda et al.
7,450,891 B2 11/2008 Muramatsu et al.
7,466,945 B2 12/2008 Hattori
7,480,476 B2 1/2009 Hosokawa et al.
7,519,317 B2 4/2009 Hosokawa et al.
7,536,139 B2 5/2009 Katsuyama et al.
7,542,703 B2 6/2009 Kasahara et al.
7,558,515 B2 7/2009 Kurita et al.
D598,949 S 8/2009 Kurenuma et al.
7,577,379 B2 8/2009 Kita et al.
D599,845 S 9/2009 Kurenuma et al.
7,590,374 B2 9/2009 Takami
7,593,674 B2 9/2009 Matsumoto et al.
D602,985 S 10/2009 Yoshizawa
7,603,054 B2 10/2009 Katsuyama et al.
7,747,202 B2 * 6/2010 Taguchi et al. ..... 399/263
7,991,334 B2 8/2011 Taguchi et al.
8,126,375 B2 2/2012 Taguchi et al.
8,160,461 B2 4/2012 Taguchi et al.
2002/0102112 A1 8/2002 Hsu
2003/0116923 A1 6/2003 Meetze et al.
2003/0117892 A1 6/2003 Litwiller
2003/0156861 A1 8/2003 Nagano et al.
2003/0219263 A1 11/2003 Tsuzuki
2004/0184841 A1 9/2004 Tsuda et al.
2004/0223790 A1 11/2004 Hosokawa et al.
2004/0258432 A1 12/2004 Hatori et al.
2004/0265011 A1 12/2004 Tsuda et al.
2005/0008398 A1 1/2005 Hattori
2005/0008400 A1 1/2005 Tazawa et al.
2005/0158071 A1 7/2005 Hosokawa et al.
2005/0196180 A1 9/2005 Harumoto
2005/0196199 A1 9/2005 Hattori
2005/0226656 A1 10/2005 Tsuda et al.
2006/0034642 A1 2/2006 Taguchi et al.
2007/0077100 A1 4/2007 Suzuki et al.
2007/0140747 A1 6/2007 Kita et al.
2009/0123192 A1 5/2009 Taguchi et al.

FOREIGN PATENT DOCUMENTS

EP 0 779 561 6/1997
EP 0 801 337 10/1997
EP 1 022 620 7/2000
EP 1 120 691 8/2001
EP 1 220 051 7/2002
JP 60-146265 8/1985
JP 04-000477 1/1992
JP 04-123074 4/1992
JP 06-59578 3/1994
JP 06-110331 4/1994
JP 6-149047 5/1994
JP 06-266227 9/1994
JP 07-20705 1/1995
JP 07-043999 A 2/1995
JP 08-137176 5/1996
JP 09-90727 4/1997
JP 09-160364 6/1997
JP 09-251240 9/1997
JP 09-311535 12/1997
JP 10-63084 3/1998
JP 10-142913 5/1998
JP 11-184232 7/1999
JP 2000-105494 4/2000
JP 2000-172058 6/2000
JP 2000-172059 6/2000
JP 2000-172060 6/2000
JP 2000-187378 7/2000
JP 2000-221766 8/2000
JP 2000-275941 10/2000
JP 2000-310901 11/2000

| | | |
|---|---|---|
| JP | 2000-338758 | 12/2000 |
| JP | 2001-5286 | 1/2001 |
| JP | 2001-27839 | 1/2001 |
| JP | 2001-125359 | 5/2001 |
| JP | 2001-265102 | 9/2001 |
| JP | 2002-6601 | 1/2002 |
| JP | 2002-139905 | 5/2002 |
| JP | 2002-169365 | 6/2002 |
| JP | 2002-221858 | 8/2002 |
| JP | 2002-244359 | 8/2002 |
| JP | 2002-268295 | 9/2002 |
| JP | 2002-268357 | 9/2002 |
| JP | 2002-276466 | 9/2002 |
| JP | 2002-357945 | 12/2002 |
| JP | 2003-35989 | 2/2003 |
| JP | 2004-018138 | 1/2004 |
| JP | 2004-139031 | 5/2004 |
| JP | 2004-226868 | 8/2004 |
| WO | WO 2004/077170 | 9/2004 |
| WO | WO 2005/076089 | 8/2005 |

* cited by examiner

BACKGROUND ART

METHOD AND TONER BOTTLE FOR IMAGE FORMING APPARATUS CAPABLE OF EFFECTIVELY SUPPLYING TONER TO IMAGE FORMING APPARATUS

CROSS-REFERENCE TO RELATED APPLICATIONS

This patent application is a division of and claims the benefit of priority under 35 U.S.C. §120 from U.S. application Ser. No. 12/816,018 filed Jun. 15, 2010, now U.S. Pat. No. 8,121,525 which is a division of and claims the benefit of priority under 35 U.S.C. §120 from U.S. application Ser. No. 12/405,309 filed Mar. 17, 2009 (now U.S. Pat. No. 7,747, 202), which is a division of and claims the benefit of priority under 35 U.S.C. §120 from U.S. application Ser. No. 11/203, 964 filed Aug. 16, 2005 (now U.S. Pat. No. 7,720,416), and claims the benefit of priority under 35 U.S.C. §119 from Japanese patent application nos. JP 2004-236249 filed on Aug. 16, 2004 and JP 2004-252324 filed on Aug. 31, 2004 in the Japan Patent Office, the entire contents of each of which are incorporated by reference herein.

BACKGROUND

1. Field of the Invention

The present invention generally relates to a toner bottle for an image forming apparatus, and more particularly to a toner bottle for an image forming apparatus which is capable of effectively supplying toner to the image forming apparatus.

2. Discussion of the Background

A background image forming apparatus that employs an electrophotographic method commonly applies toner as a dry ink to visualize an image in an image forming operation. Such an apparatus includes a printer, a copier, a facsimile machine, and a multi-function system, for example. The multi-function system combines varieties of image forming related functions including at least two of printing, copying, and facsimile functions.

The background image forming apparatus initially stores a predetermined amount of toner in a toner container and supplies the toner to an image development mechanism which develops an image with the toner. That is, the amount of toner stored in the container is gradually reduced as the toner consumed at each time the image development mechanism performs an image development operation.

In this operation, the background image forming apparatus needs to supply toner from the toner container to the image development mechanism according to the amount required by the image development mechanism. If the toner is not appropriately supplied to the image development mechanism, an inferior image forming phenomena occurs such as a faint image or an uneven color, for example, due to uneven toner density.

When the toner is used up and the toner container becomes empty, the toner container needs to be exchanged, which is normally done by an operator. In exchanging the toner container, the toner is apt to scatter and fly around the area so that operator's hands and cloths may be soiled by the scattered toner. Therefore, the toner container needs to be designed so as to be exchanged as easily as possible by an operator.

Among a variety of toner containers which have been produced, a toner cartridge and a toner bottle are typical examples. The toner bottle, for example, typically has a cylindrical shape and is provided at its one end with an opening to output toner stored in the toner bottle. The opening usually has a diameter smaller than that of a main body of the toner bottle where the toner is stored. Such a toner bottle is usually placed horizontally in the image forming apparatus so that the toner is smoothly output to a mechanism, more particularly to an image development mechanism, requiring the toner.

One example of a background toner bottle is shown in cross section in FIG. 1. As illustrated in FIG. 1, a background toner bottle 90 includes a bottle body 91 and a cap 92. The bottle body 91 is cylindrically shaped. The cap 92 includes a cap part 93 and a holder part 94. The cap 92 is also cylindrical shaped and is configured to be non-rotatably stationed and to allow the bottle body 91 to rotate about the cap 92.

The cap part 93 is provided with a toner supply opening 95 at a bottom portion thereof. The holder part 94 is fixed with the cap part 93 and is configured to hold the cap part 93 to the bottle body 91. The bottle body 91 is configured to rotate about the cap part 93 latched with a hook part 96 formed at the holder part 94 to a dike formed on the bottle body 91.

The cap 92 further includes a seal material 97 arranged at a contact portion between the bottle body 91 and the cap part 93 to avoid leakage of the toner, and a pulling member 98 and a shutter 99 both arranged at the holder part 94. The cap 92 is engaged to the bottle body 91 by a connecting gear.

In the toner bottle, the toner must be able to move in a horizontal direction towards the opening and to be output from the opening to the image forming mechanism. However, an appropriate conveyance and output of the toner may not be achieved without the help of a mechanical device for moving the toner. If the toner bottle is not provided with any such mechanical device, an amount of toner output from the toner bottle may vary, particularly when the toner in the toner bottle is reduced to a relatively small amount. This makes the toner supply system unreliable.

Also, another problem may occasionally be caused when the toner bottle is not provided with an adequate mechanical device, in which a relatively great amount of toner is found remaining in the toner bottle after the toner bottle is exchanged.

Moreover, since the toner has a tendency to gather into clumps in addition to its low liquidity, a risk of obstructing a moving path for the toner with the toner clumps is relatively high if no adequate mechanical device for appropriately moving the toner is present.

SUMMARY OF THE INVENTION

This patent specification describes a novel toner bottle for an image forming apparatus which is capable of effectively supplying toner to the image forming apparatus. The toner bottle may be used in an image forming apparatus and exchanged with another bottle when necessary. The toner bottle includes a bottle body typically having a cylindrical shape and configured to contain toner, a gear to rotate a part of the toner bottle, a cap attached to the bottle body and including an opening arranged in a circumferential surface of the cap and configured to output toner to a development member of the image forming apparatus, a toner conveyance mechanism arranged in the bottle body and configured to convey toner to the opening.

This patent specification further describes a novel toner bottle in which the toner conveyance mechanism includes a stirring member fixed to the bottle body and configured to extend to the opening of the cap to stir the toner.

Further, this patent specification describes a novel toner bottle in which the toner conveyance mechanism includes another unique structure of a coil configured to stir and convey toner in the bottle body to the opening by the rotation of the coil spring in accordance with rotation of the bottle gear.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
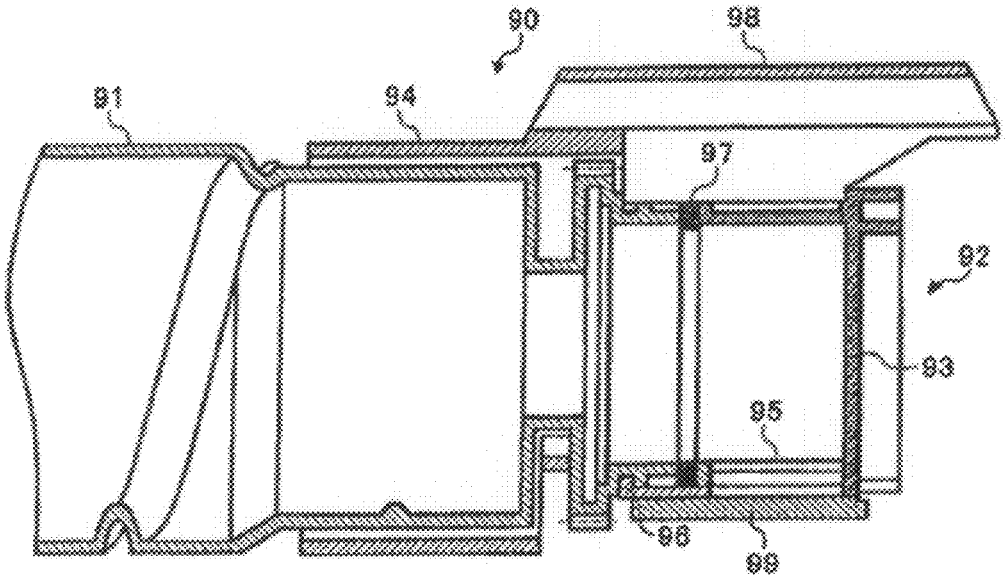
FIG. 1 illustrates a cross sectional view of a background toner bottle.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 2, an image forming apparatus according to a preferred embodiment of the present invention is explained.

Figure 2:
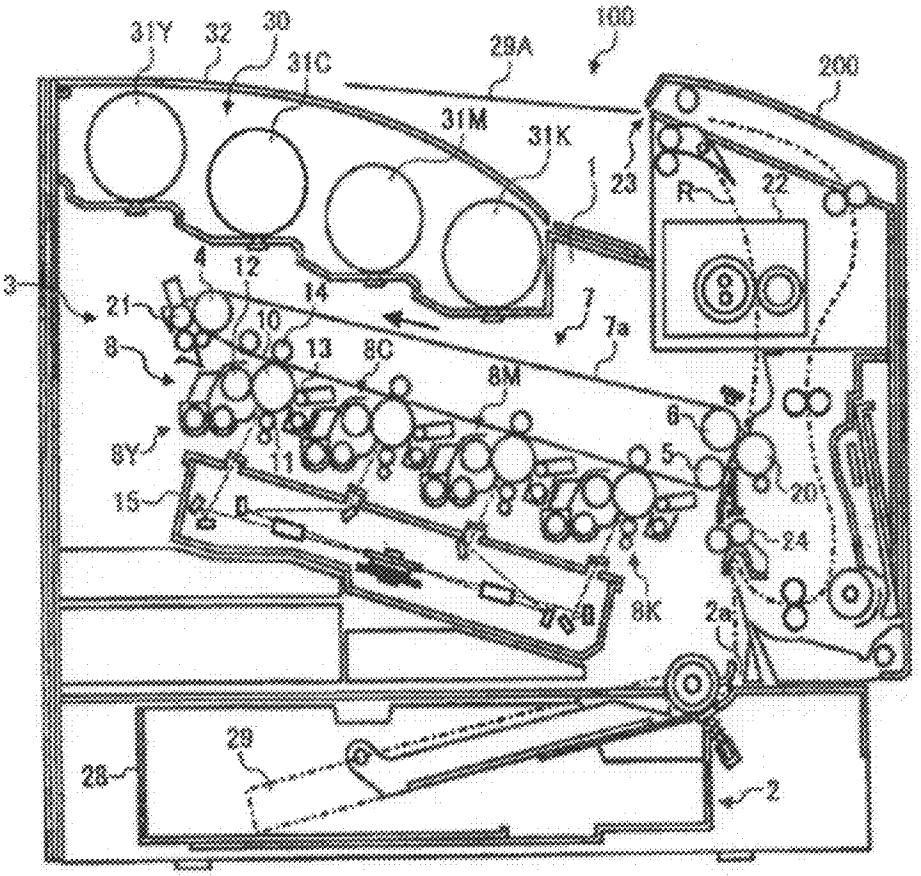
FIG. 2 illustrates a basic configuration of an image forming apparatus according to one exemplary embodiment of the present invention.

A color laser printer 100 illustrated in FIG. 2 is one example of the image forming apparatus according to an exemplary embodiment of the present invention.

As illustrated in FIG. 2, the color laser printer 100 includes a paper storage section 2, an image forming section 3, a fixing apparatus 22, a paper holding section 32, a toner supply section 30 and a cover 200. The paper storage section 2 includes a paper cassette 28 which stores paper sheets 29. The fixing apparatus 22 fixes a toner image on the paper sheet 29. The paper holding section 32 holds the printed paper sheets 29A. The paper sheet 29 is carried through a carrier track R between the paper storage section 2 and the paper holding section 32 via the fixing apparatus 22.

The image forming section 3 includes an intermediate transfer unit 7, an image forming device 8, a light-writing unit 15, a secondary transfer roller 20 and a resist roller 24. The image forming section 3 is placed above the paper cassette 28 in the middle of the color laser printer 100.

The intermediate transfer unit 7 includes an endless intermediate transfer belt 7*a*, a plurality of rollers 4, 5, 6 and a belt cleaning device 21. The endless intermediate transfer belt 7*a* is extended among the rollers 4, 5, 6. The rollers 4 and 5 are configured to support the lower side of the intermediate transfer belt 7*a*. The roller 6 is configured to face the carrier track R. The belt cleaning device 21 is installed at a side of the roller 4 opposite of the intermediate transfer belt 7*a* to clean up the surface of the intermediate transfer belt 7*a*.

The light-writing unit 15 writes images to image holding members. The secondary transfer roller 20 is installed at a side of the roller 6 opposite the intermediate transfer belt 7*a* and configured to face the carrier track R.

The image forming device 8 is placed beneath the intermediate transfer belt 7*a* to face the lower surface of the intermediate transfer belt 7*a*. The image forming device 8 includes four image forming units 8Y, 8C, 8M and 8K having the respective image holing member. The intermediate transfer unit 7 and the image forming units 8Y, 8C, 8M and 8K may be configured to be removable from the image forming system.

Each one of the image forming units 8Y, 8C, 8M and 8K includes a photosensitive drum 10, a charging member 11, a development member 12, a cleaning member 13 and a first transfer roller 14. The charging member 11, the development member 12 and the cleaning member 13 are arranged around the photosensitive drum 10.

The photosensitive drum 10 is configured to face the intermediate transfer belt 7*a* and works as the image holding member. The first transfer roller 14 is installed at inner side of the intermediate transfer belt 7*a*. The intermediate transfer belt 7*a* is located between the transfer roller 14 and the photosensitive drum 10. The image forming units 8Y, 8C, 8M and 8K are similarly configured in this system. For simplicity, the label numbers are indicated for the image forming unit 8Y, as shown in FIG. 2.

The image forming units 8Y, 8C, 8M and 8K have a difference from each other in color of the toner used as a developer. Each one of the image forming units 8Y, 8C, 8M and 8K contains yellow, cyan, magenta and black color toner, respectively. When the toner stock in the corresponding development member 12 dwindles, the toner is supplied from corresponding toner bottle 31Y, 31C, 31M, and 31K installed in the toner supply section 30 in an upper part of the color laser printer 100. In FIG. 2, reference numeral 31 denotes a toner bottle which generally refers to any one of the toner bottles 31Y, 31C, 31M, and 31K.

The light-writing unit 15 is arranged underneath the image forming part 8 and electrostatically forms a color image on the surface of the photosensitive drum 10 by irradiating a laser beam L. The intermediate transfer unit 7, the image forming device 8, the toner supply section 30 and the light-writing unit 15 may be arranged with a tilt of a predetermined angle relative to the horizontal direction for the purpose of saving space.

At the beginning of the image forming process, the photosensitive drum 10 is driven to rotate in a clockwise direction by a driver (not shown). The surface of each one of the photosensitive drums 10 is charged uniformly by the charging member 11 for making an electrostatic latent image. The electrostatic latent image is then formed on the surface of the each photosensitive drum 10 by being irradiated by the laser beam L. The data used for the irradiation is the single color information data broken down from the full color information data to each color information data, (i.e., yellow, cyan, magenta and black). While the photosensitive drum 10 passes through the point of the development member 12, the electrostatic latent image is visualized as a toner image.

One of the rollers 4, 5, 6 is driven to rotate in a counterclockwise direction by a driver (not shown). In accordance with the rotation of the roller, the intermediate transfer belt 7*a* is subjected to move in the direction, as shown by an arrow in FIG. 2. The other rollers are also made to move by the intermediate transfer belt 7*a*. A yellow toner image is formed at the image forming unit 8Y which includes the development member 12 with yellow toner and is transferred on the intermediate transfer belt 7*a* by the first transfer roller 14. A full color toner image is formed on the intermediate transfer belt 7*a* by superimposing cyan, magenta and black toner images in addition to the yellow toner image with a similar process.

After the transfer process is completed, toner remaining on the surface of the photosensitive drum 10 is then removed by the cleaning member 13, and the electric charge of the surface of the intermediate transfer belt 7*a* is also removed by a neutralization member (not shown) for initialization to prepare the next image forming process.

On one hand, the paper sheet 29 is fed from the paper cassette 2 to the resist rollers 24 through the carrier track R. The paper is then held by the resist rollers 24. In accordance with timing determined by a detector (not shown), placed at the resist rollers 24, which locates between the paper cassette 2 and the secondary transfer roller 20, the paper sheet 29 is carried to the secondary transfer roller 20.

On the other hand, an opposite polarity potential relative to the charge on the toner is applied to the secondary transfer roller 20. The toner image on the surface of the intermediate transfer belt 7*a* is then transferred to the paper 29 due to the force of the polarity potential. After the transferring process, the paper sheet 29 holding the toner image is carried to the fixing apparatus 22. While the paper sheet 29 is passing through the fixing apparatus 22, the toner is melted and fixed by heat and pressure.

The printed paper sheet 29A holding the fixed toner image is carried to the ejection part 23 which is the last part of the carrier track R and ejected to the paper holding part 32 arranged at the upper part of the color laser printer 100. The remaining toner on the intermediate transfer belt 7*a* is removed by the belt cleaning device 21. As the image forming units 8Y, 8M, 8C and 8K are arranged in parallel facing the intermediate transfer belt 7*a*, the four toner images are superimposed one after another on the intermediate transfer belt 7*a* during the transfer process.

Comparing to another color laser printer using a rotary development method which needs four cycles to complete the development process of the full color image, the color laser printer 100 takes a shorter image forming time to complete the development process. Additionally, a more compact system can be achieved because the paper holding part 32 is embedded at the upper part of the color laser printer 100.

The operation for full color image forming is described above. However, the operation is also applicable for a single color image forming operation using one of the four image forming units and for a two or three color image forming operation performed in the same way.

Figure 3:
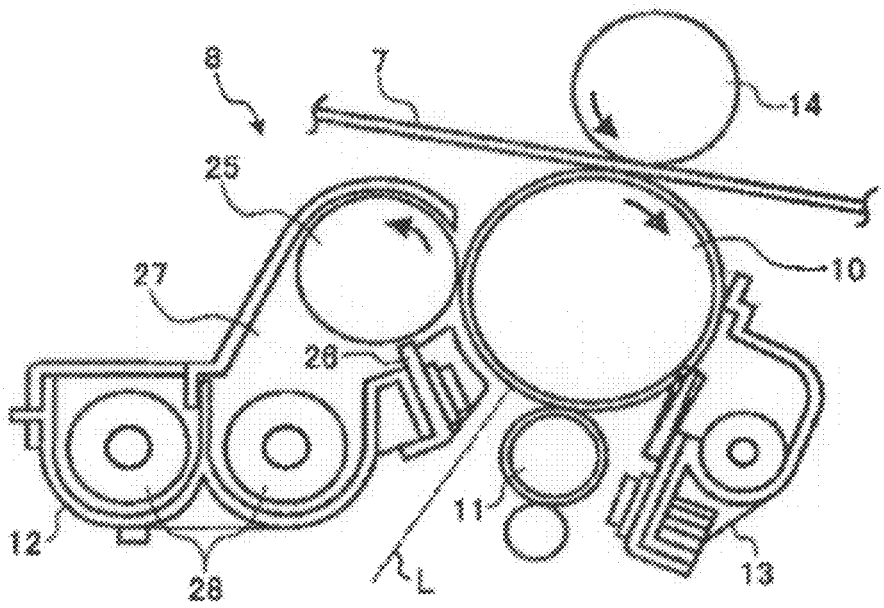
FIG. 3 illustrates a development apparatus of the image forming apparatus of FIG. 2.

FIG. 3 illustrates a configuration of an image forming unit which is a part of the image forming device 8. The image forming unit includes a photosensitive drum 10, a charging member 11, a development member 12, a cleaning member 13 and a first transfer roller 14 as shown in FIG. 3. The development member 12 includes a development sleeve 25, a blade 26, a developer storage 27 and toner transfer screws 28.

The development sleeve 25 includes a magnetic generation device inside and is configured to convey a two-component developer which includes magnetic particles and toner on the surface of the development sleeve 25 as a toner support member of developer. The blade 26 is a developer controlling member which controls thickness of the developer being conveyed on the development sleeve 25. The developer storage 27 is formed located at a starting side in a direction to which the toner is conveying so that the remaining toner which is removed by the blade 26 and is not conveyed to the development zone to which the photosensitive drum 10 faces is to be returned to the developer storage 27. At lower side of and adjacent to the developer storage 27, the toner transfer screws 28 are arranged to stir and convey the toner.

At the beginning of operation of the development process, a developer layer is formed on the development sleeve 25. And more toner is captured on the developer layer from the developer storage 27 by rotation of the development sleeve 25. It is performed to capture the toner under a predetermined temperature range. The toner captured in the developer is charged by the frictional electrification with carriers. The developer which includes charged toner is supplied to the surface of the development sleeve 25. As the development sleeve 25 includes a magnet inside, the developer is held by magnetic force.

By way of example, the developer layer held by the development sleeve 25 is conveyed in accordance with the rotation of the development sleeve 25 to a direction shown by an arrow. The thickness of the developer layer is controlled by the blade 26, then the developer layer is conveyed to the development zone to which the photosensitive drum 10 faces. At the development zone, a developing process is performed based on a latent image formed on the photosensitive drum 10. Remaining developer layer on the development sleeve 25 is conveyed to the starting side in a direction to which the toner in the developer storage 27 is conveyed in accordance with the rotation of the development sleeve 25.

Figure 4:
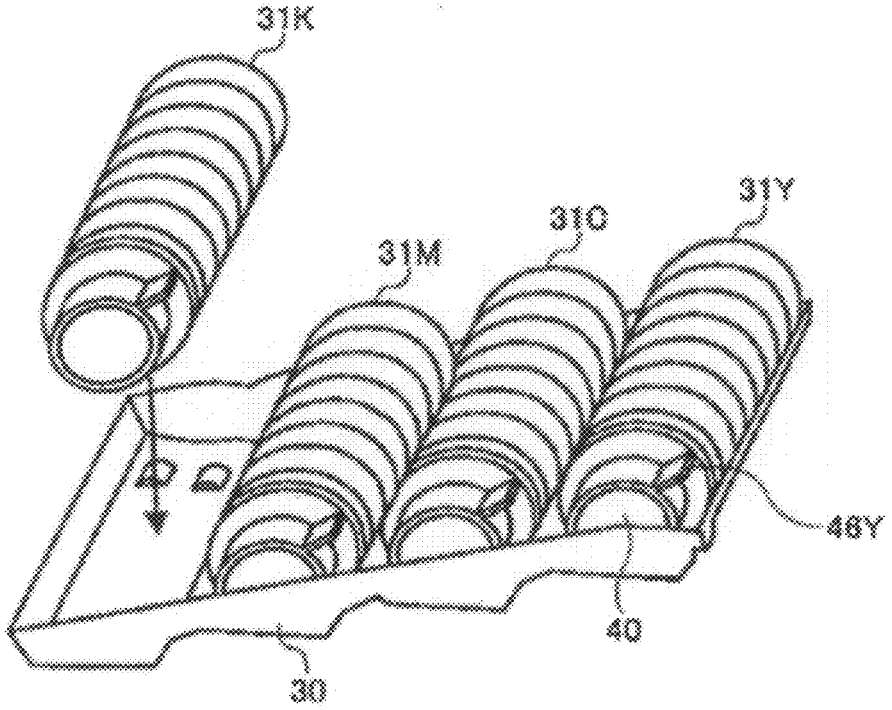
FIG. 4 illustrates a toner supply section and a plurality of toner bottles placed in the toner supply section.

FIG. 4 illustrates a way of installing the toner bottle 31K, as an example, into the toner supply section 30 in which the toner bottles 31Y, 31C, and 31M are previously placed. As demonstrated in FIG. 4, the toner bottle 31K is laid and is placed from above into a predetermined position in the toner supply section 30.

Figure 5:
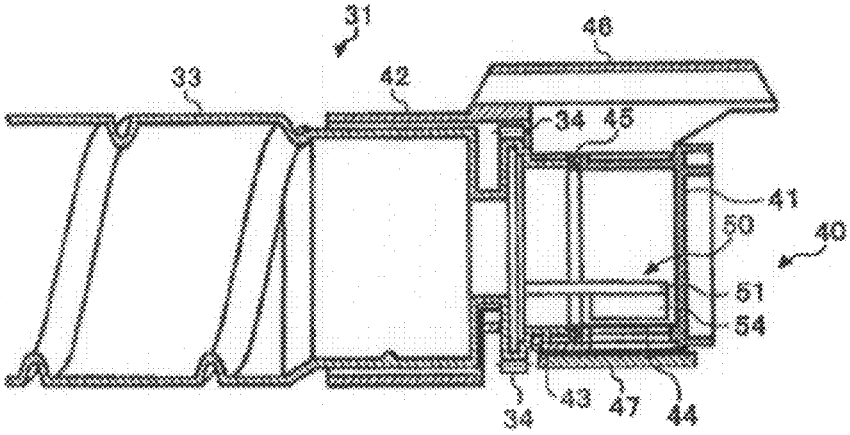
FIG. 5 illustrates a perspective view of an exemplary embodiment of the bottle body.

In one non-limiting embodiment illustrated in FIG. 5, the toner bottle 31 includes a bottle body 33 and a cap 40. The bottle body 33 is typically cylindrically shaped. The cap 40 includes a cap part 41 and a holder part 42. The cap 40 is also typically cylindrical shaped and is configured to be non-rotatably stationed and to allow the bottle body 33 to rotate about the cap 40.

The cap part 41 is provided with a toner supply opening 44 at a bottom portion thereof. The holder part 42 is fixed with the cap part 41 and is configured to hold the cap part 41 to the bottle body 33. The bottle body 33 is configured to rotate about the cap part 41 latched with a hook part 43 formed at the holder part 42 to a dike formed on the bottle body 33.

The cap 40 further includes a seal material 45 arranged at a contact portion between the bottle body 33 and the cap part 41 to avoid leakage of the toner, and a pulling member 46 and a shutter 47 arranged at the holder part 42. The cap 40 is engaged to the bottle body 33 via a bottle gear 34.

When the toner bottle 31 is attached in the color laser printer 100, the paper holding part 32 which covers the toner supply section 30 is pulled upward. The toner supply section 30 is then opened and is accessible from outside above. After that, the toner bottle 31 may be put on the toner supply section 30 from above as shown in FIG. 4 and the pulling member 46 is rotated. The cap 40 rotates in accordance with the rotation of the pulling member 46, because the cap 40 is configured to fix with the pulling member 46.

When the shutter 47 is moved in a circumferential direction, the toner supply opening 44 is opened. At the same time, the cap 40 engages with the toner supply section 30 and the toner bottle 31 is fixed to the toner supply section 30. The toner bottle 31 is now set in the toner supply section 30 and is coupled to a driving gear (not shown) which is arranged in the color laser printer 100 and is driven by the bottle gear 34.

On the other hand, the toner bottle 31 is released from the toner supply section 30 by rotating the pulling member 46 to a reverse direction. At the same time, the slide 47 makes the toner supply opening 44 closed. It is possible to take the toner bottle 31 out from the color laser printer 100 by taking the pulling member 46 out. In this color laser printer 100, it is easy and user-friendly to set and remove the toner bottle 31 because the toner bottle 31 is possible to be taken out to the upper side of the color laser printer 100.

Moreover, it is easy to fix the toner bottle 31 to the toner supply section 30 simply by rotating the cap 40 because the pulling member 46 formed on the cap 40. When the toner bottle 31 is taken out from the color laser printer 100, the shutter 47 is kept closed in order not to spill the toner out, even if the pulling member 46 is rotated.

Figure 6:
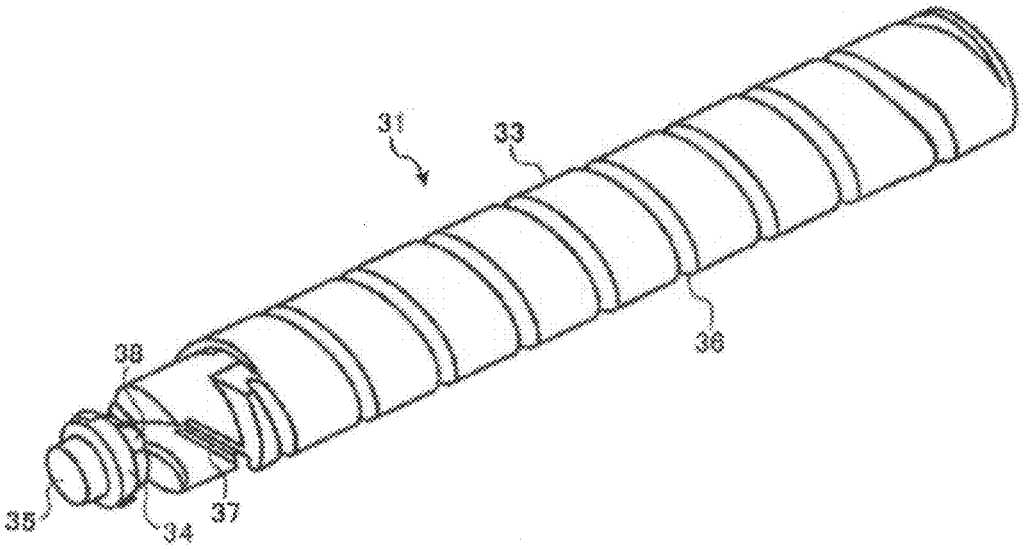
FIG. 6 illustrates a perspective view of an exemplary embodiment of the present invention.

An oblique perspective view of the bottle body 33 is shown in FIG. 6. Spiral shaped projection 36 is formed at an inner side of the bottle body 33 and the toner stored is conveyed to an opening of an opening part 35 of the bottle body 33 by the spiral shaped projection 36 when the bottle body 33 is rotated.

The opening of the opening part 35 is formed with a concentric ring structure to the bottle body 33 and a diameter of the opening is formed smaller than a diameter of the bottle body 33. Secondary spiral 37 is formed from an end of the spiral shaped projection 36 to the opening part 35 to draw the toner out from the small opening part 35. Two lift-up parts 38 are arranged at each 180 degree turn in this embodiment and are configured to draw the toner to the secondary spiral 37.

On this toner bottle 31, the toner accretes and coheres on the wall of the cap 40, which is the opposite side to the opening part 35. The accreted toner builds up gradually and narrows the toner supply opening 44. The toner supply opening 44 may be closed by the toner in the worst case scenario. If the toner which has low liquidity is used, narrowing and closing the toner supply opening 44 frequently take place.

The exemplary embodiment of the toner bottle 31 of FIG. 5 further includes a stirring member 50 which is arranged on the bottle body 33 and is extending to the cap 40 as shown in FIG. 5. The stirring member 50 rotates together with the bottle body 33 because the stirring member 50 is fixed to the bottle body 33. The stirring member 50 includes a stirring rod 51. The stirring rod 51 extends to the toner supply opening 44 and a front-end of the stirring rod 51 is located in the toner supply opening 44, or the stirring rod 51 extends over the toner supply opening 44.

Moreover, the stirring rod 51 is typically located close to the wall of the cap 40 to move along when rotated. The stirring member 50 rotates when the bottle body 33 rotates because the stirring member 50 is formed as a substantial single-piece construction with the bottle body 33. Meanwhile, the cap 40 is fixed to the color laser printer 100, the stirring member 50 moves along the inner periphery of the cap 40 and scrapes the accreted toner off from the wall of the cap 40.

According to this exemplary embodiment, it can be avoided that the accreted toner increases gradually and narrows the toner supply opening 44 and closes the toner supply opening 44 in the worst case. It can be made to supply toner effectively. The stirring rod 51 stirs the toner fed from the bottle body 33 and mixes the toner with air so that fluidization of the toner is accelerated. As a result, the toner increases in liquidity and less of a tendency to gather into clumps. Accordingly, the toner may be fed to the development member 12.

Figure 7:
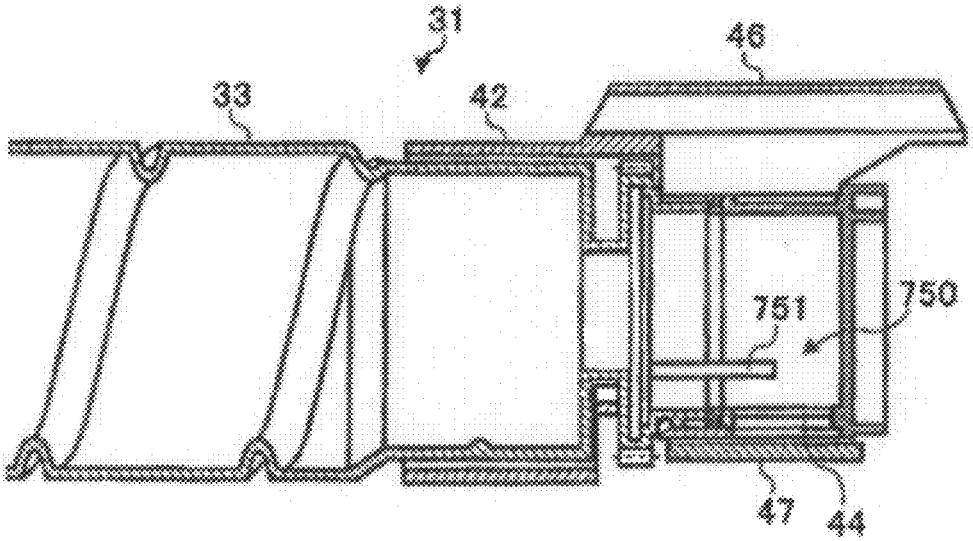
FIGS. 7-10 illustrates cross sectional views of toner bottles.
Figure 8:
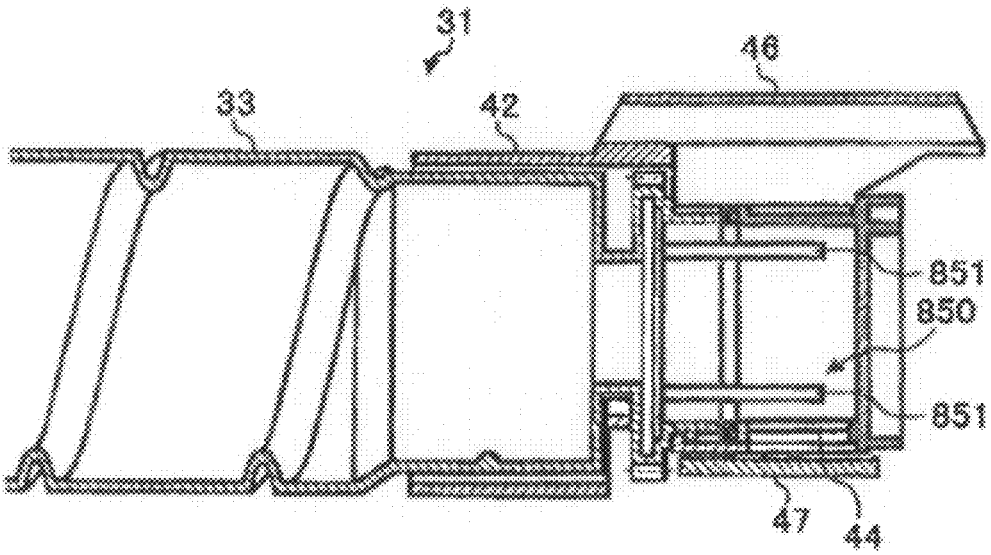

Moreover, the stirring rod 51 is typically long enough to extend beyond the toner supply opening 44 shown in FIG. 5 or to extend to half way of the toner supply opening 44 as shown in FIG. 7. In addition, the stirring rod 51 may include a flexible film 54 such as MYLAR (R). The flexible film 54 may be positioned to touch inner wall of the cap 40 or may be set slightly apart from the inner wall of the cap 40.

Table 1 below shows results of an experiment in which an effect of the stirring rod was investigated and whether toner becomes looser in the cap 40 using the toner bottle 31. Toner which has a tendency to gather into clumps and two types of stirring rods are used.

TABLE 1

| | trial time | | | | |
|---|---|---|---|---|---|
| stirring rod | 1 | 2 | 3 | 4 | 5 |
| no stirring rod | C | C | C | C | C |
| use stirring rod (length 1) | C | B | B | C | B |
| use stirring rod (length 2) | A | A | A | A | A |

In Table 1, "A", "B", and "C" represent different results. In "A", toner becomes looser and belches out from the bottle. In "B", toner becomes slightly looser, but the amount of the toner which belches out from the bottle is small. In "C", toner does not become looser and does not belch out from the bottle. Also, the length 1 represents a length of a stirring rod extending to an area before the front-edge of the toner supply opening. Similarly, the length 2 represents a length of a stirring rod extending into toner supply opening.

One of the stirring rods extends to the toner supply opening 44 but ends before the front-edge of the toner supply opening 44. The other extends to the toner supply opening 44 such that an edge of the stirring rod is in the toner supply opening 44. In the Table 1, the notation "A" shows a result where toner becomes looser and belches out from the bottle. The notation "B" shows result where toner becomes slightly looser, but the amount of the toner which belches out from the bottle is small. The notation "C" shows a result where toner does not become looser and does not belch out from the bottle.

Referring to Table 1, it is possible to supply the toner stably and in a constant amount using stirring member 50 even if the toner has a strong tendency to gather into clumps. Moreover, it is found that the result is not very good when the stirring rod extends to toner supply opening 44 but ends before the front-edge of the toner supply opening 44.

Figure 9:
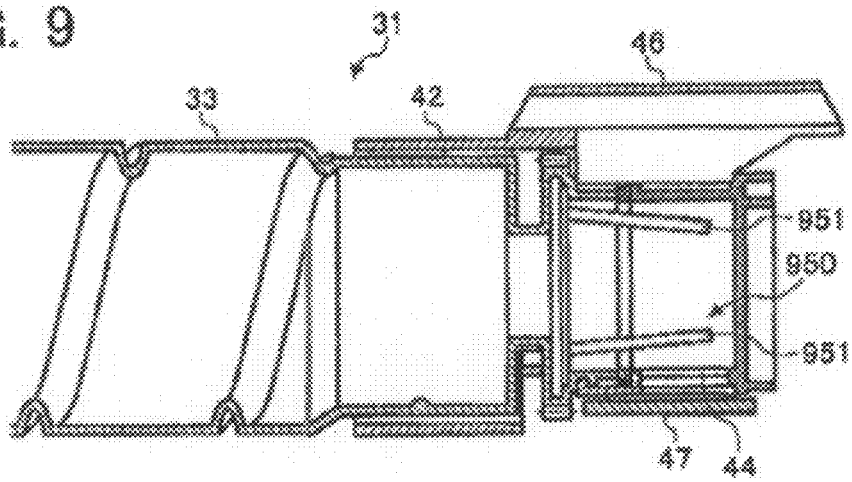

Referring to FIGS. 7 to 10, non-limiting embodiments of various modified stirring members based on the stirring member 50 are described. In FIG. 7, the bottle body 33 is provided with a stirring member 750 which has a length shorter than the stirring member 50 of FIG. 5 but has an edge still over the toner supply opening 44. A stirring member 850 shown in FIG. 8 has two stirring rods 851. As an alternative, more than two stirring rods may be installed. In FIG. 9, the bottle body 33 is provided with a stirring member 950 which includes two slant stirring rods 951. Further, in FIG. 10, the bottle body 33 is provided with a stirring member 1050 which includes two parallel stirring rods 1051 connected with a connecting rod 1055.

Figure 11:
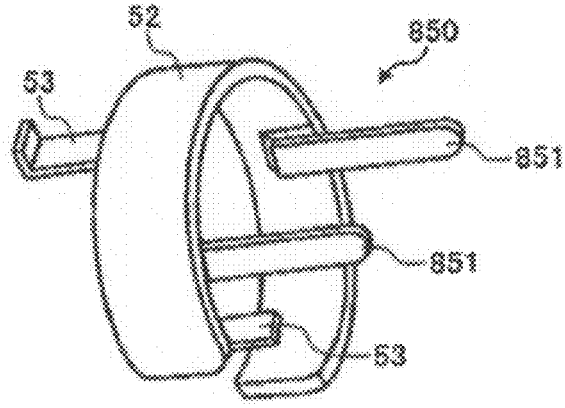
FIG. 11 illustrates an oblique perspective view of a stirring member.

FIG. 11 illustrates an oblique perspective view of an exemplary embodiment of stirring member 850. The stirring member 850 may include a ring member 52, locking parts 53 and the stirring rods 851. The stirring rods 851 are typically arranged on an inner side of the ring member 52 which has an open portion, and two locking parts 53 are arranged at other portions of the ring member 52. It is possible to attach the stirring member 850 to the toner bottle 31 easily by latching the locking parts 53 to the lift-up parts 38.

The stirring rods 851 on the ring member 52 are displaced from the locking parts 53 so that toner which is feeding out through the lift-up parts 38 is stirred efficiently. More specifically, the stirring rods 851 are arranged at a place to efficiently stir the toner which is drawn from the lift-up parts 38. Then the toner is fed out from the toner bottle 31.

As shown in FIG. 9, the stirring member 950 includes stirring rod 951 which is formed in a plate shape and is arranged with a tilt of an angle relative to an axis line of the bottle body 33. The stirring rod 951 is arranged closer to the axis line of the bottle body 33 at a point closer to opening 35. By arranging the stirring rod 951 to tilt, a transfer path is formed along a plane of the stirring rod 951. Consequently, an amount of residual toner is reduced because the toner can be conveyed efficiently.

Figure 10:
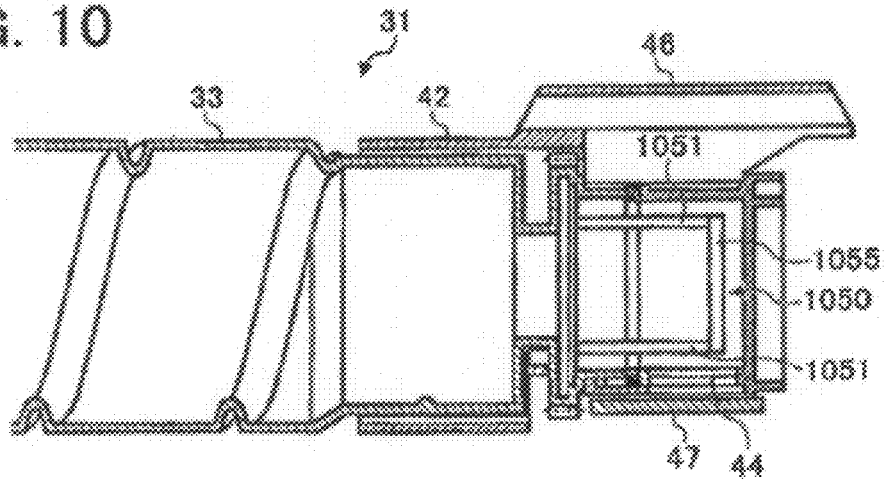

As shown in FIG. 10, the stirring member 1050 includes the coupling rod 1055 to connect top parts of the stirring rods 1051. The stirring member 1050 which includes the coupling rod 1055 stirs toner accreted at areas opposite to the cap 40 to the opening part 35 so that flocculation of the toner can be avoided steadily. The coupling rod 1055 is also applicable to the structure of the stirring rod 951 shown in FIG. 9.

The toner bottle 31 is set to the color laser printer 100 typically in a way in which the axis of the toner bottle 31 is substantially parallel to the horizontal direction. In this situation, toner may remain in the bottle because of no help of gravity. Used toner bottle can be treated as a waste materials. However, when a lot of the toner remains in the toner bottle and is not treated as a waste material the remaining toner may become a problem not only from an economical point of view but also from an environmental point of view. Users may distrust the manufacturer to find a lot of toner remained in the toner bottle when the user changes the toner bottles. Therefore, it is beneficial to reduce the toner in the used toner bottle as much as possible. The present invention provides tremendous reduction of the remaining toner in the toner bottle and a solution to provide a stable toner supply.

Figure 12:
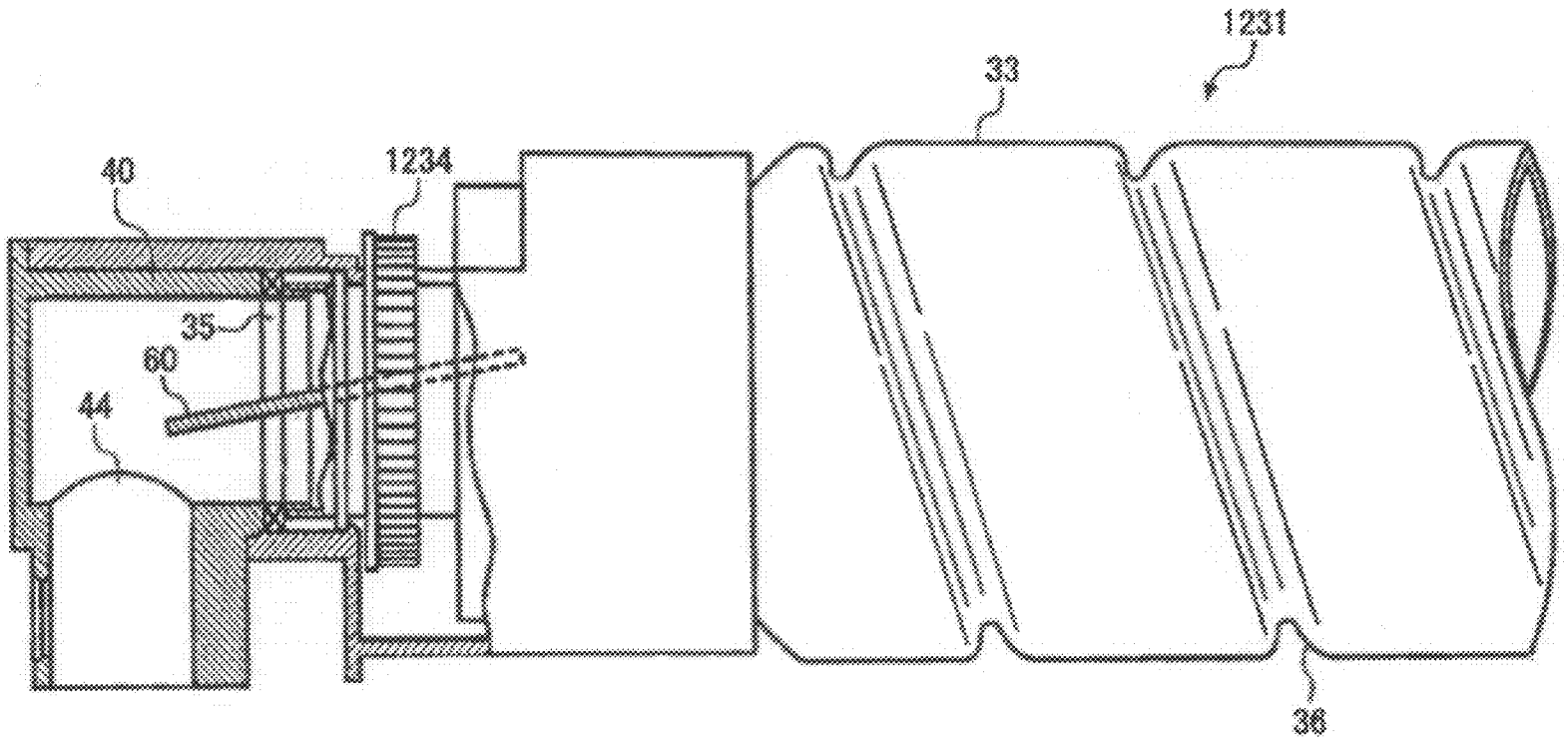
FIG. 12 illustrates another toner bottle with a cross-sectional view of a cap and an oblique perspective view of a bottle gear and bottle body of the toner bottle.
Figure 13:
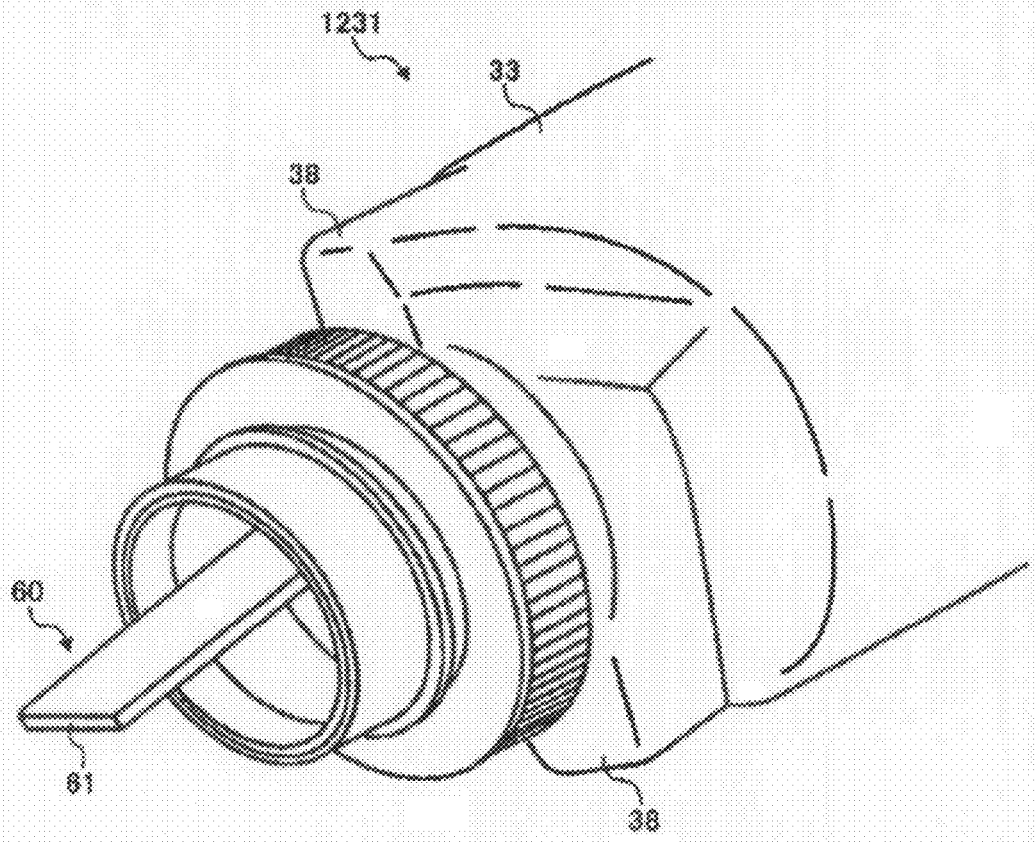
FIG. 13 illustrates an oblique perspective view of a top part of another toner bottle.

FIG. 12 illustrates another toner bottle 1231 with a cross-sectional view of the cap 40 and an oblique perspective view of a bottle gear 1234 and the bottle body 33 of the toner bottle 1231. FIG. 13 illustrates an oblique perspective view of a top part of the toner bottle 1231. The toner bottle 1231 includes a conveyance member 60. The conveyance member 60 is arranged at the bottle body 33 and is formed in a plate shape and is extending to the cap 40. An end of the conveyance member 60, which is located at a downstream side of the toner flow, extends to the toner supply opening 44. Another end of the conveyance member 60 extends to a boundary between the spiral shaped projection 36 and the secondary spiral 37. Namely, the conveyance member 60 has a length which covers the whole secondary spiral 37.

Moreover, FIG. 12 is shows a case of the bottle body 33 in which the toner is falling down from the lift-up parts 38 to the conveyance member 60. The conveyance member 60 is attached with a tilt of an angle relative to a plane which includes the axis of the bottle body 33. In other words, the conveyance member 60 is tilted to have an end of the conveyance member 60 at high position of in the bottle body 33 and an opposite end of the conveyance member 60 at a low position.

In this toner bottle 31, the toner is moved to the opening part 35 with a help of the spiral shaped projection 36 and is lifted up by the lift-up parts 38 at an end of the secondary spiral 37 when the bottle body 33 is rotated. When the bottle body 33 rotates further and one of the lift-up parts 38 takes a higher position, most of the toner falls down from the lift-up part 38 to a surface of the convey member 60. The toner is then conveyed to the toner supply opening 44 moving along the surface of the conveyance member 60.

By the introduction of the conveyance member 60, it is possible to convey to the toner supply opening 44 of the cap 40 not only the toner which comes out of the opening part 35 of the bottle body 33, but also the toner which is stayed inside of the cap 40. As a result, the toner can be conveyed to the toner supply opening 44 of the cap 40 smoothly, even if the opening part 35 is small compared to the bottle body 33.

Namely, a sufficient amount of toner can be conveyed to the toner supply opening 44 even if the toner in the toner bottle 31 has dwindled and the amount that remains is not sufficient to provide a stable supply. According to the embodiment, it is possible to achieve stable toner supply with a sufficient amount of toner. Additionally the toner remaining in the bottle is less when the toner bottle 31 is no longer useful compared to conventional structured toner bottles. The bottle body 33 includes two of the lift-up parts 38 as shown in FIG. 13. Hence, the toner drops twice at a turn of the bottle body 33.

Figure 14A:
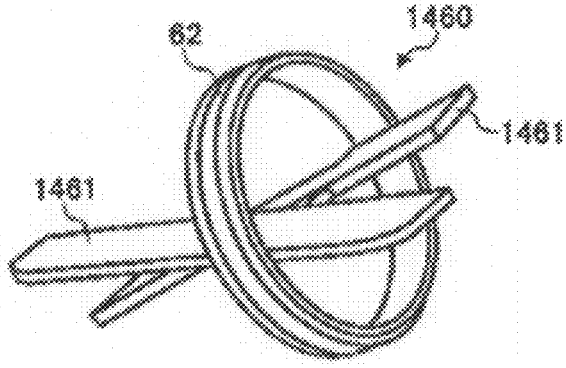
FIG. 14A, FIG. 14B and FIG. 14C illustrate other embodiments of a conveyance member installed in the toner bottle.
Figure 14B:
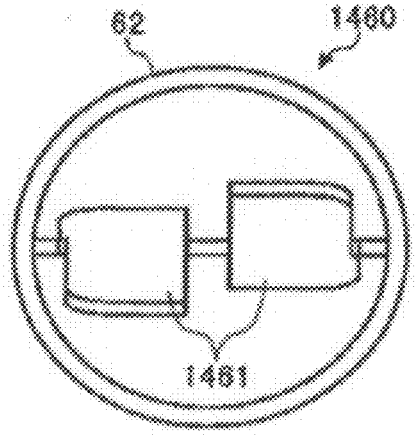
Figure 14C:
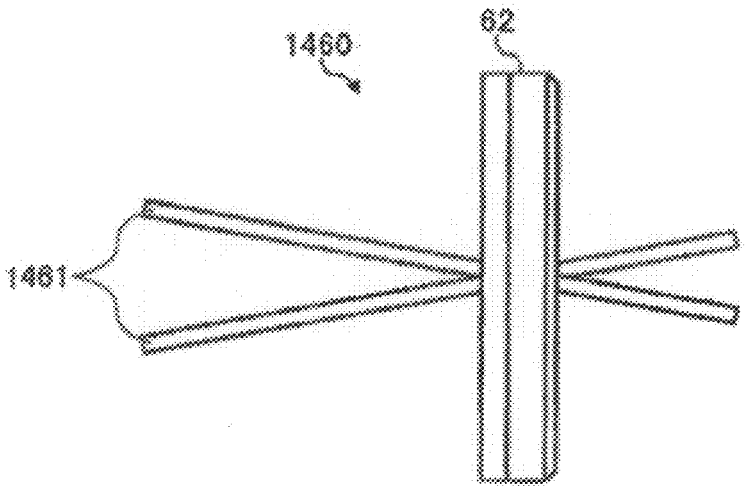

FIG. 14A, FIG. 14B and FIG. 14C illustrate other non-limiting embodiments of conveyance member 1460. The conveyance member 1460 includes two conveyance plates 1461 which are same in number as the lift-up parts 38. The two conveyance plates 1461 are arranged with a tilt of an angle relative to an axis line of the bottle body 33. Using this convey member 1460, more stable toner supply with a constant amount can be achieved, and remaining toner when the toner bottle is too empty to be used is reduced dramatically. The conveyance member 1460 is attached to the bottle body 33. Therefore, manufacturing and assembly becomes easier, if the convey member 1460 includes a support ring 62 having the conveyance plates 1461 as shown in FIG. 14A, FIG. 14B and FIG. 14C. This configuration reduces cost.

Figure 15:
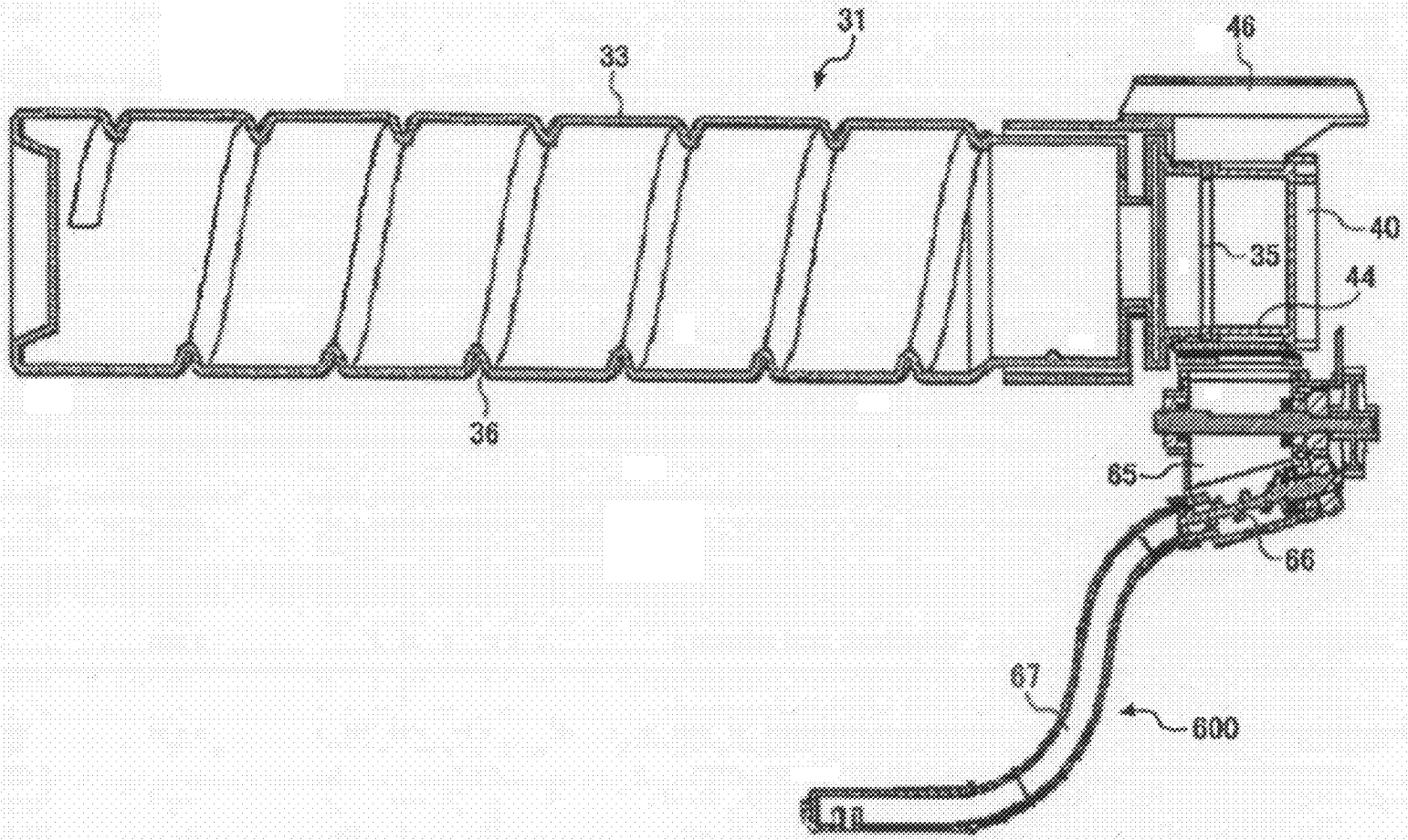
FIG. 15 illustrates a cross-sectional view of the toner bottle with a toner supply equipment.

FIG. 15 illustrates the toner bottle 31 with a toner supply apparatus 600. The toner supply apparatus 600 includes a toner accumulation portion 65, a conveyance screw 66 and a toner transfer pipe 67. The toner supply opening 44 of the cap 40 is connected to the toner accumulation portion 65. The toner transfer pipe 67 and the conveyance screw 66 are arranged underneath of the toner accumulation portion 65. The toner transfer pipe 67 is a path to the development member 12. The conveyance screw 66 sends the toner to the toner transfer pipe 67 and the conveyance screw 66 is tilted so that the toner is conveyed smoothly with a help of gravity force.

In accordance with an instruction from a control apparatus (not shown) to supply toner, the conveyance screw 66 starts to rotate and the toner supply apparatus 600 supplies toner to the development member 12. At the same time, the bottle body 33 rotates because the bottle gear 34 is engaged with a driving gear (not shown). By the rotation of the bottle body 33, the toner is supplied to the cap 40 with the help of the spiral shaped projection 36, the secondary spiral 37 and the lift-up parts 38. During this toner supply process, the stirring member 50 is rotated together with bottle body 33 to stir the toner and the toner is moved to the toner supply opening 44 without stagnation.

Figure 16:
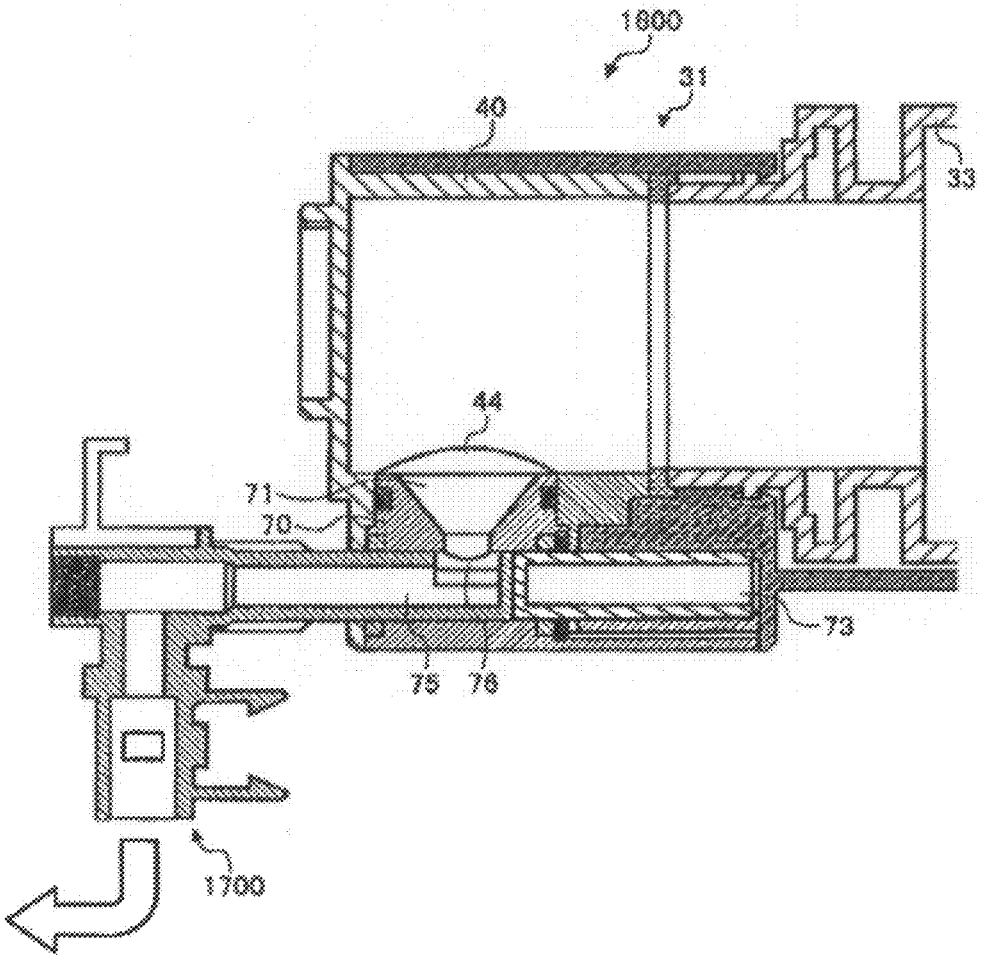
FIG. 16 and FIG. 17 illustrate an another toner supply equipment and a nozzle equipment of another toner bottle.
Figure 17:
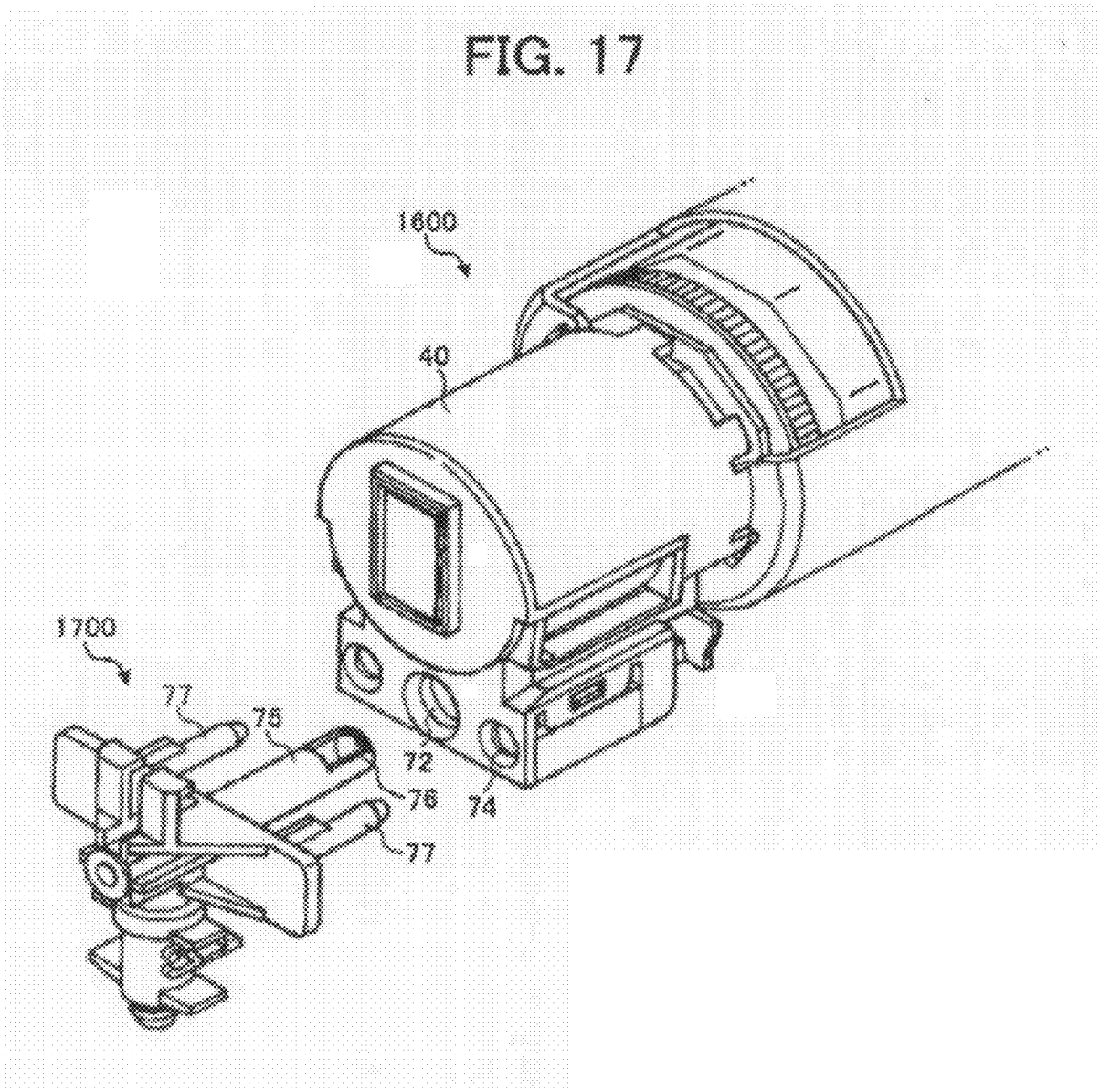

FIG. 16 and FIG. 17 illustrate another toner supply apparatus 1600 and a nozzle apparatus 1700. The toner supply equipment 1600 includes a vent member 70 which has a funnel type opening 71 and a nozzle opening 72 to which a nozzle 75 is plugged in. The funnel type opening 71 of the vent member 70 is communicating to the toner supply opening 44 of the cap 40 at the upper part of the funnel type opening 71 and is communicating to a nozzle opening 72 at the lower end. A series of toner convey path is closed by fitting a shutter 73 to the nozzle opening 72.

When the toner bottle 31 is set in the color laser printer 100, the nozzle 75 is plugged into the nozzle opening 72 and the shutter 73 is pushed by the nozzle 75 and moves to a closer position to the bottle body 33. Then the funnel type opening 71 is communicated with a socket connection 76 formed in the nozzle 75. Locating pins 77 are arranged and are configured to plug into locating holes 74 formed in the vent member 70.

The other side of nozzle 75 is communicated with an import port of a powder pump (not shown) installed at the development member 12 through a conveyance pipe (not shown). The powder pump is a single axis, eccentric absorption type screw pump, generally made up of a screw-like rotor, a stator, and a holder. The powder pump is frequently used to provide sufficient conveyance of toner.

When the powder pump is used for the toner supply equipment 1600, it is beneficial to have a condition in which the funnel type opening 71 is completely filled with toner. If the funnel type opening 71 is not completely filled with the toner and the powder pump absorbs air through voids of the toner, the powder pump may not work well. Therefore, it is beneficial that the funnel type opening 71 is filled with toner except a last moment when the toner bottle becomes empty.

As to manufacturing process of the bottle body 33, the bottle body 33 and the bottle gear 34 are sometimes manufactured separately, and then attached with an adhesive. However, such manufacturing procedure is not very cost effective. In order to reduce cost, it is proposed to use polyethylene terephthalate as a construction material. The opening part 35 which includes the bottle gear 34 of the bottle body 33 is made with an injection molding machine and toner storage part is then formed using a flow shaping process.

Using this process, it is possible to form a single-piece construction of the bottle body 33 and the bottle gear 34. Consequently, it is possible to adjust gears with high attaching accuracy because of the single-piece construction of the bottle body 33 and the bottle gear 34. Moreover, recycling efficiency is improved because the bottle body 33 and the bottle gear 34 are made of a single material.

Figure 18:
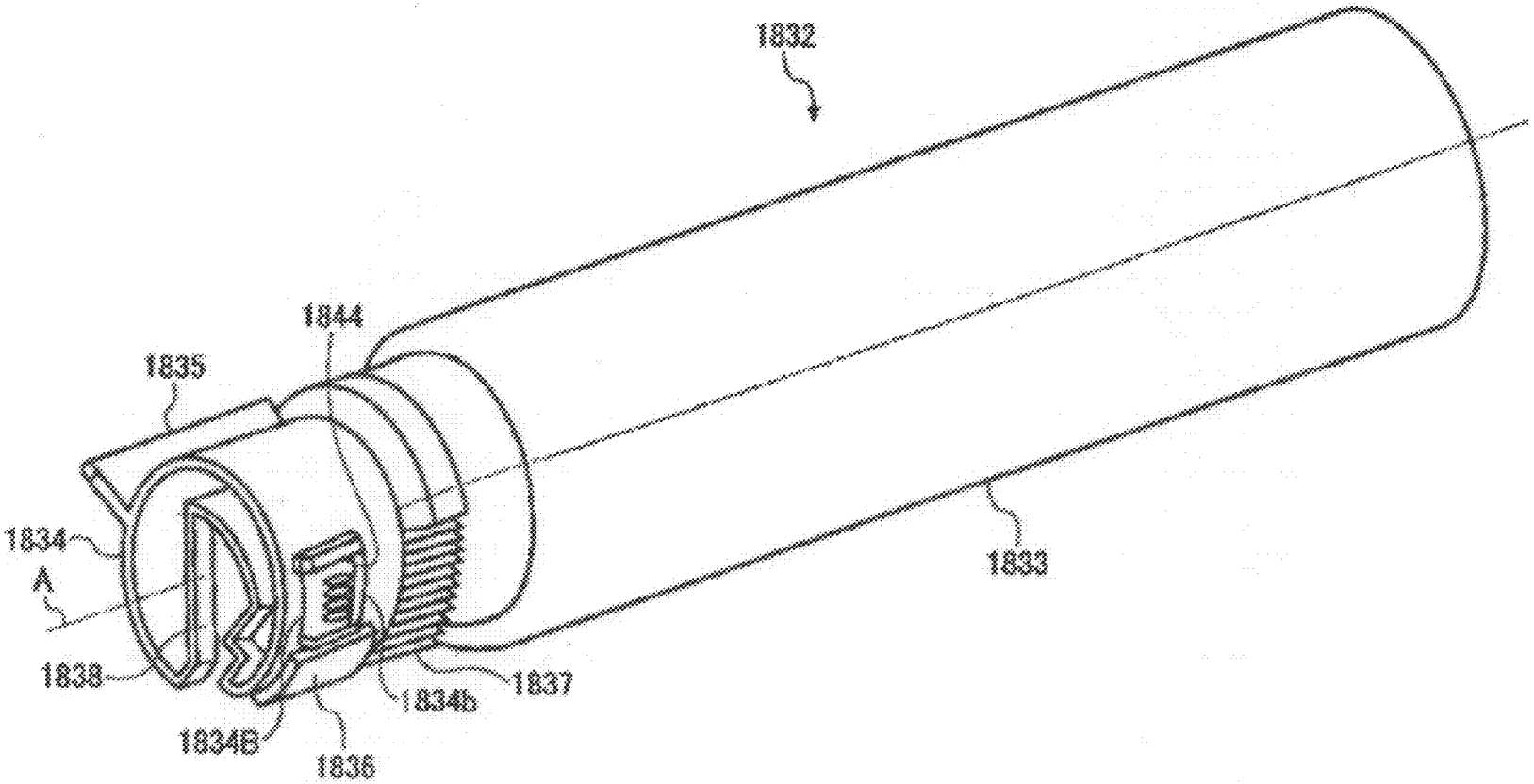
FIG. 18 illustrates an oblique perspective view of another toner bottle.

FIG. 18 illustrates another exemplary embodiment of the toner bottle 1832. The toner bottle 1832 includes a bottle body 1833, a bottle gear 1837 and a cap 1834. The bottle body 1833 is cylindrically shaped, but does not include a spiral shaped projection in this toner bottle 1832.

Figure 19:
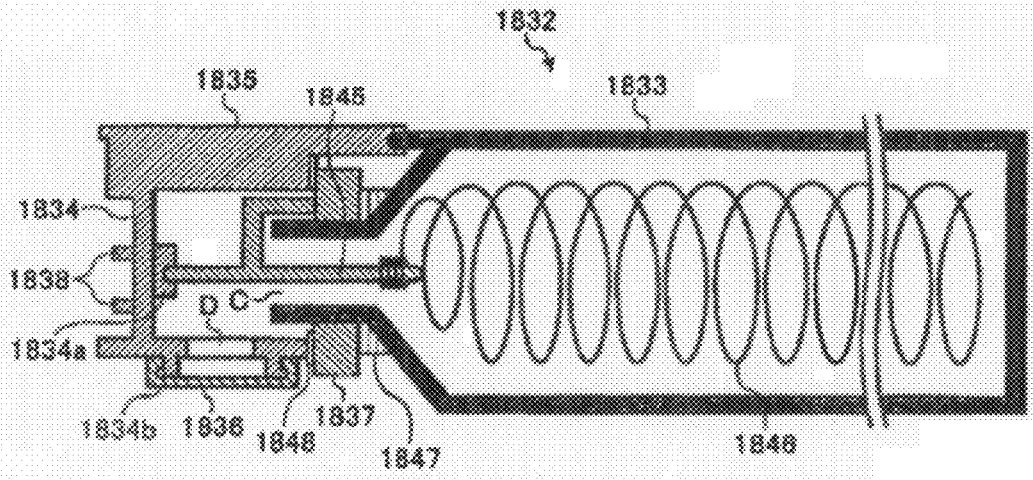
FIG. 19 illustrates a cross-sectional view of another toner bottle.

FIG. 19 illustrates a cross sectional view of the toner bottle 1832. A rotation member 1845 is attached to the bottle gear 1837. A coil spring 1846 is attached to the rotation member 1845 and extends to the inside of the bottle body 1833. When bottle gear 1837 is rotated relative to the bottle body 1833, the rotation member 1845 and the coil spring 1846 are rotated in accordance with the rotation of the bottle gear 1837. The bottle body 1833 is configured to be non-rotatably stationed in this embodiment.

The toner stored in the bottle body 1833 is conveyed to an bottle opening C of the bottle body 1833 by a conveyance force generated by the rotation of the coil spring 1846. Since an outer diameter of the coil spring 1846 is smaller than an inner diameter of the bottle body 1833, the convey force of the coil spring 1846 also affects the toner which is located around center of the bottle body apart from an inner circumference of the bottle body 1833. Thus, the toner in the bottle body 1833 is conveyed to the opening C of the bottle body 1833.

Moreover, the coil spring 1846 wobbles when the coil spring 1846 is rotated because the coil spring 1846 is flexible and is fixed only at an end of the coil spring 1846. As a result, the conveyance force of the coil spring 1846 can affect the whole toner inside of the bottle body 1833 from the inner circumference to the center. Even if the toner is fully stored in the bottle body 1833 and is gathered into clumps due to being left unused for a long time or due to an environmental changes, the conveyance force of the coil spring 1846 loosens the clumps and keeps a sufficient amount of conveying toner.

The bottle gear 1837 is typically arranged between the bottle body 1833 and the cap 1834 and adjacent to the outer circumference of the bottle opening C of the bottle body 1833. A gum elastic member 1847 may be arranged at an end of the bottle gear 1837 and a seal member 1848 is arranged at another end in order to avoid spilling toner out from the toner bottle 1832.

Figure 20:
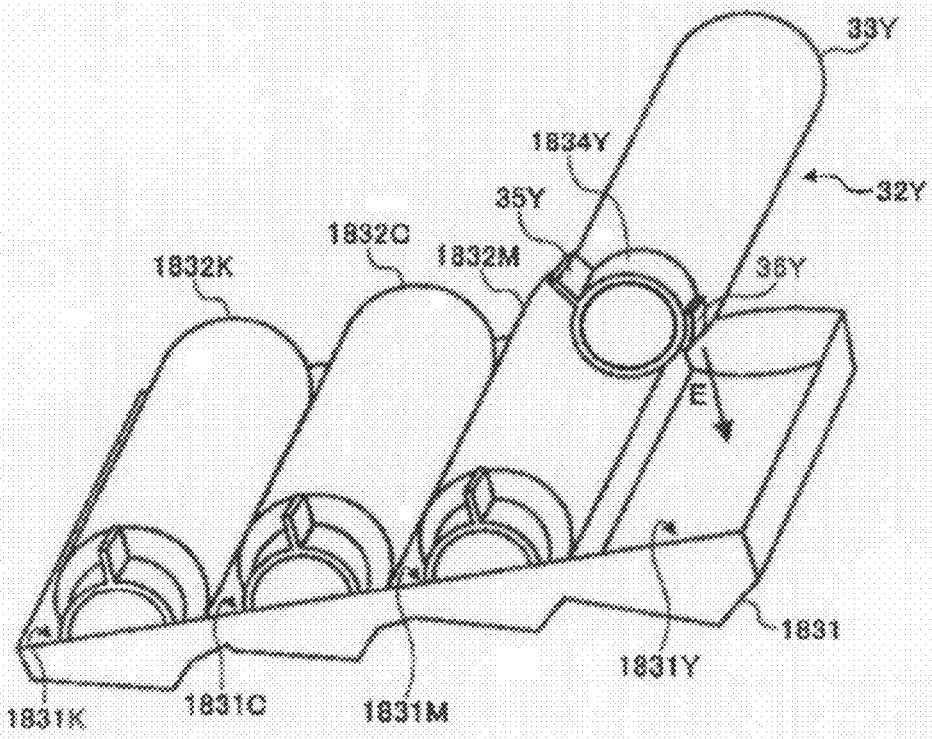
FIG. 20 illustrates a toner supply section and another toner bottle.

FIG. 20 illustrates a toner supply section 1831 and toner bottles (1832Y, 1832M, 1832C and 1832K). The toner bottle 1832Y which includes yellow toner is shown as about to be attached to the toner supply section 1831 in FIG. 20.

Figure 21:
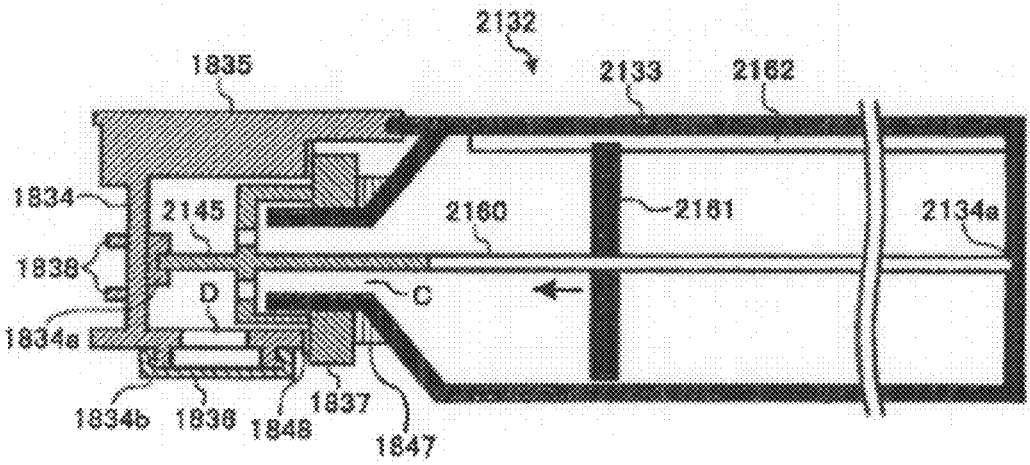
FIG. 21 illustrates a cross-sectional view of another toner bottle.

FIG. 21 illustrates an a cross sectional view of another toner bottle 2132. The toner bottle 2132 includes a rotation member 2145, a screw rod 2160 and a toner conveyance plate 2161 as a conveyance mechanism. The screw rod 2160 is fixed to the bottle gear 1837 via a rotation member 2145. The toner convey plate 2161 is attached to the screw rod 2160. More specifically, a female screw 2161*a* of the toner convey plate 2161 is engaged with a male screw 2160*a* of the screw rod 2160.

Figure 22:
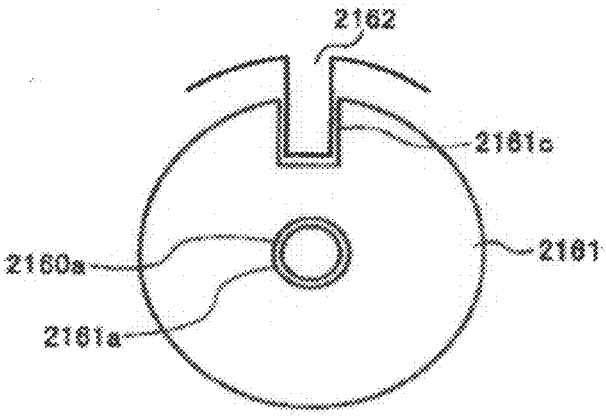
FIG. 22 illustrates a guide member which is arranged at the inner circumference of the bottle body of the toner bottle.

A cutout 2161*c* is formed in the toner conveyance plate 2161 to engage with a guide member 2162 which is arranged at the inner circumference of the bottle body 2133 as shown in FIG. 22. An end of the rotation member 2145 is shown fixed to a rod socket 1834*a* of the cap 1834 and an end of the screw rod 2160 is shown fixed to a bottom socket 2134*a* arranged at a bottom of the bottle body 2133.

The screw rod 2160 is driven to rotate when the bottle gear 1837 rotates about the bottle body 2133. In accordance with the rotation of the screw rod 2160, the toner conveyance plate 2161 is moved to the bottle opening C under guidance of the guide member 2162. The speed of the movement of the toner conveyance plate 2161 is controlled in consideration of toner consumption speed in the bottle body 2133. Thus, the toner is conveyed by the conveyance force of the toner conveyance plate 2161.

An outer diameter of the toner conveyance plate 2161 is formed smaller than an inner diameter of the bottle body 2133. Therefore, the convey force of the toner convey plate

2161 affects the substantially all toner in the bottle body 2133 including toner which is located around the center of the bottle body 2133 apart from an inner circumference of the bottle body 2133. Even if the toner is fully stored in the bottle body 2133 and is gathered into clumps due to being left unused for a long time or due to an environmental changes, the conveyance force of the toner convey plate 2161 loosens the clumps and keeps a sufficient amount of conveying toner.

Numerous additional modifications and variations are possible in light of the above teachings. It is therefore to be understood that within the scope of the appended claims, the disclosure of this patent specification may be practiced otherwise than as specifically described herein.

What is claimed is:

1. A powder container for use in an image forming apparatus, the powder container comprising:

a container body configured to contain powder;

a gear configured to rotate relative to a cap when dispensing the powder;

the cap attached to the container body and including an opening configured to output the powder, the cap being at an end of the container body;

a shutter configured to shut the opening and prevent the powder from passing through the opening when the powder container is outside of the image forming apparatus and the cap is attached to the container body; and a stirring member fixed relative to the gear and extending to the opening, the stirring member configured to rotate with the gear while the cap is outputting the powder, wherein the stirring member is rod-shaped.

2. The powder container of claim 1, wherein:

the gear is exposed through a side of the cap.

3. The powder container of claim 2, wherein:

the gear is partially contained within the cap.

4. The powder container of claim 1, wherein:

the gear is partially contained within the cap.

5. The powder container of claim 1, wherein:

the stirring member is configured to agitate the powder inside the cap.

* * * * *